United States Patent [19]

Esser et al.

[11] Patent Number: 4,878,009

[45] Date of Patent: Oct. 31, 1989

[54] VOLTAGE SOURCE HAVING PRESET VALUES FOR SOURCE VOLTAGE AND INTERNAL RESISTANCE

[75] Inventors: Wolfgang Esser; Peter Jung, both of Paderborn, Fed. Rep. of Germany

[73] Assignee: Nixdorf Computer AG, Paderborn, Fed. Rep. of Germany

[21] Appl. No.: 226,168

[22] Filed: Jul. 29, 1988

[30] Foreign Application Priority Data

Jul. 30, 1987 [DE] Fed. Rep. of Germany ..... 3725348

[51] Int. Cl.[4] ..... G05F 1/46

[52] U.S. Cl. ..... 323/275; 323/280; 323/285

[58] Field of Search ..... 323/274, 275, 276, 277, 323/280, 284, 285, 286, 287, 297, 353–354

[56] References Cited

U.S. PATENT DOCUMENTS 4,311,954 1/1982 Capel ..... 323/285
4,536,699 8/1985 Baker ..... 323/276
4,580,089 4/1986 Grunsch et al. ..... 323/285
4,678,983 7/1987 Rouzies ..... 323/285
4,748,398 5/1988 Laue ..... 323/285

*Primary Examiner*—Peter S. Wong
*Attorney, Agent, or Firm*—Dykema Gossett

[57] ABSTRACT

A voltage source with preset values of the source voltage and the internal resistance is simulated by a computing circuit (25, 26; 35, 36; 47) which calculates a reference parameter ($S_{UO}$; $S_{IO}$) for a current or voltage regulator (20; 30; 40) that forms the output of the voltage source. The reference parameter ($S_{UO}$; $S_{IO}$) corresponds to the output current ($I_O$) or the output voltage ($U_O$) and is obtained from a measured parameter ($M_{UO}$; $M_{IO}$) and the input parameters ($S_U$; $S_R$) which correspond to the values to be set. The measured parameter ($M_{UO}$; $M_{IO}$) is derived from the output voltage ($U_O$) or the output current ($I_O$). When using this simulation circuit, separate high load resistors and mechanical switching contacts are unnecessary and the input parameters ($S_U$; $S_R$) can be set with analog switches.

17 Claims, 2 Drawing Sheets

VOLTAGE SOURCE HAVING PRESET VALUES FOR SOURCE VOLTAGE AND INTERNAL RESISTANCE

TECHNICAL FIELD

This invention concerns a circuit arrangement for a voltage source that delivers an output current or an output voltage and has preset source voltage and internal resistance values.

BACKGROUND OF THE INVENTION

Voltage sources whose source voltage and internal resistance can be preset independently of each other, i.e., can be adjusted, are needed for testing electronic equipment or circuit groups, for example, to determine their reaction to different input switching modes. The voltage source connected to the inputs is then set at different source voltages and internal resistance values in succession. A circuit arrangement which makes this possible contains an adjustable voltage source with which a resistance arrangement that can be switched between several resistance values is connected in series and serves as a switchable internal resistance of the voltage source. The switching device can be a manually operated selector switch but it is also possible to implement such switching devices in the form of a relay arrangement.

When such an arrangement consisting of a voltage source and variable internal resistance is to be switched, not manually but instead by electric selection signals, optionally even automatically through a predetermined sequence of source voltage values and internal resistance values, this can be accomplished with a digitally adjustable voltage source in combination with a relay circuit. Use of electronic analog switches for switching the internal resistance values is impossible in many applications because such switch elements do not have sufficient dielectric strength and their inherent resistance can cause measurement errors in the range of low internal resistance values.

Therefore, with voltage sources of the type described here, a mechanical switch contact is needed for each preset internal resistance value. In the sense of achieving the greatest possible operating reliability, the switchable internal resistors must also be able to withstand the high loads that occur in the event of a short circuit. This requires high expenditures in terms of space and costs.

The purpose of this invention is to implement the independent adjustment of source voltage and internal resistance of a voltage source in such a way that no mechanical switch contacts and no separate high rated resistors are necessary.

This invention solves this problem for a circuit arrangement of the type described initially by means of a computing circuit for calculating a reference parameter for a current or voltage regulator that forms the output of the voltage source from a measured parameter that corresponds to the output voltage or the output current and the input parameters corresponding to the preset values.

A circuit arrangement according to this invention thus does not contain the series circuit of a voltage source with a resistance arrangement but instead the current or voltage regulator serves to simulate the behavior of a voltage source with preset values for source voltage and the internal resistance at its output terminals by calculating its reference parameter according to the response that is to be simulated. In this way the switchable internal resistors as well as the switch device with the mechanical switch contacts become superfluous and the reference parameters to be supplied to the circuit arrangement in accordance with the values to be preset can be set with analog switches because they only have a controlling function.

The calculation of the reference parameter for the current or voltage regulator to be performed with the computing circuit is very simple because it is based on the fact that the behavior of a voltage source at a preset source voltage and internal resistance value can be described completely by the output voltage and the output current. The output voltage and the output current of a voltage source can be represented by forming a simple difference and product depending on the internal resistance and source voltage. Therefore, the circuit arrangement according to this invention is further refined in that the computing circuit contains an adder and a multiplier in series connection, each of which receives one of the two input parameters. The difference formed from the output voltage and source voltage which is necessary to simulate the response of the voltage source can be determined very simply with a known amplifier due to the fact that a control voltage that is proportional to the output voltage and a control voltage that is proportional to the source voltage and is of opposite sign are supplied to its inputs. Then the summation amplifier has the advantage in comparison with a digital adding circuit that its amplification can be adjusted, e.g., in a feedback path, so the difference between the output voltage and the source voltage can be varied in this way easily by a factor that is proportional to the internal resistance in accordance with the response of the voltage source in simulating the output voltage, and is inversely proportional to the internal resistance in simulating the output current. This yields a very simple circuit where only a single amplifier is provided in the computing circuit so the source voltage and the internal resistance can be adjusted on this amplifier and the difference can be formed and the multiplication can be performed for calculating the reference parameter for the downstream current and/or voltage regulator simultaneously.

Thus an advantageous version of this invention consists of the fact that the summation amplifier has a feedback path that can be adjusted according to different preset values of the internal resistance. In such a feedback path, a normal multiplying digital-analog converter can be provided as an impedance network to adjust different internal resistance values. Converters of this type are known to need a virtual mass point for current summation. Such a mass point is also provided with summation amplifiers. The advantage of using such a multiplying converter consists of the fact that it permits multistage adjustment of the internal resistance on the summation amplifier with commercial integrated circuits.

If when using a current regulator the measured parameter corresponding to the output voltage is measured with a voltage sequence circuit, then especially in the case of a high internal resistance value or small loads connected to the circuit, their high input resistance achieves the effect that the output current of the circuit corresponds pratically to the output current of the current regulator supplying the output current, because the input current of the voltage measurement circuit is then negligibly small.

A circuit according to this invention, especially in the version with a summation amplifier, is especially suitable for setting complex internal resistance values because the impedance network in the feedback path of the summation amplifier must then be formed only inductively or capacitively accordingly.

BRIEF DESCRIPTION OF THE DRAWINGS

This invention will now be explained in greater detail with reference to the accompanying figures

DESCRIPTION OF THE PREFERRED EMBODIMENTS

Figure 1:
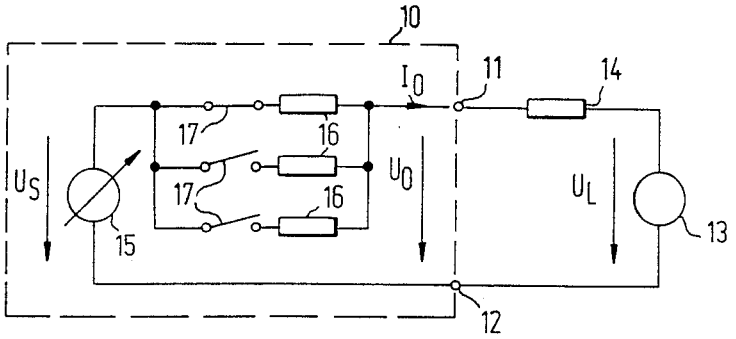
FIG. 1 shows a general diagram of a voltage source with an adjustable source voltage and a variable internal resistance to illustrate the operation at its output terminals.

FIG. 1 shows a voltage source 10 which supplies an output voltage $U_0$ or an output current $I_0$ at its output terminal 11 and 12. Any load can be connected to voltage source 10. In FIG. 1, such a load is represented as a series connection of another voltage source 13 with a load resistor 14.

Voltage source 10 contains an ideal voltage source 15 which supplies a source voltage $U_S$ and is connected in series with a resistor arrangement 16 in which the individual resistors can each be connected individually and effectively to a switching device 17. If the source voltage $U_S$ at the ideal voltage source 15 as shown in FIG. 1 can be set at different values, then the source voltage $U_S$ and its internal resistance can be preset at different levels. Voltage sources suitable for the measurement purposes measured initially have this technical circuitry design.

The response of the voltage source 10 shown in FIG. 1 at its output terminals 11 and 12 can be described completely by the two following equations depending on the source voltage $U_S$ and its internal resistance $R_I$:

$$U_0 = U_S - R_I \cdot I_0 \quad (1)$$

$$I_0 = 1/R_I(U_S - U_0) \quad (2)$$

Figure 2:
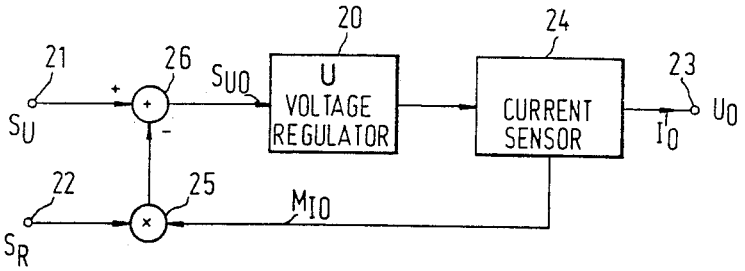
FIG. 2 shows a schematic diagram of a circuit according to this invention using a voltage regulator.
Figure 3:
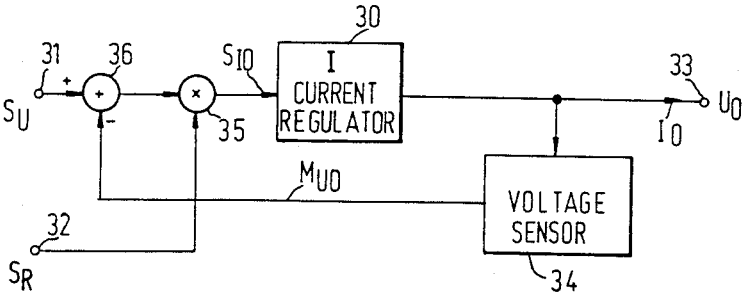
FIG. 3 shows a schematic diagram of a circuit according to this invention using a current regulator.

FIGS. 2 and 3 show circuits according to this invention having this response, but they do not have an adjustable ideal voltage source and they do not have individually switchable resistors.

FIG. 2 shows a circuit arrangement with a voltage regulator 20 that delivers an output voltage $U_0$ or an output current $I_0$ at an output terminal 23 and is controlled by a reference parameter $S_{U0}$ which is in turn formed by a computing circuit with a subtractor 26 and a multiplier 25. An input parameter $S_U$ that is proportional to the preset source voltage of the voltage source formed with the total circuit is sent to subtractor 26 through input terminal 21. An input parameter $S_R$ that is proportional to the internal resistance to be set is sent to multiplier 25 via input terminal 22. A current measurement circuit 24 is provided at the output of voltage regulator 21 and output current $I_0$ is sent over this measurement circuit which then delivers to the multiplier 25 a measured parameter $M_{I0}$ that is proportional to the output current.

In this way the product of the input parameter $S_R$ that is proportional to the internal resistance that is to be set and the measured parameter $M_{I0}$ that is proportional to the output current $I_0$ is formed and subtracted in subtractor 26 from the input parameter $S_U$ which is proportional to the source voltage that is to be set, because the product formed by multiplier 25 is sent to subtractor 26 as an input parameter. The subtractor then yields the reference parameter $S_{U0}$ which controls the voltage regulator 20 on the basis of the values to be preset for the source voltage and internal resistance in such a way that the voltage regulator delivers the desired output voltage $U_0$ at the measured current $I_0$.

Operation of the circuit arrangement shown in FIG. 2 thus satisfies equation (1) given above so it has the response of a voltage source of the type shown in FIG. 1, but the respective internal resistor is not arranged in the output current circuit, and instead a value proportional to it is supplied as the input parameter $S_R$, the factor of a multiplication process. Likewise the circuit does not contain an ideal voltage source but instead an input parameter $S_U$ that is proportional to a source voltage value that is to be preset is supplied to it.

FIG. 3 shows one practical example of this invention with a current regulator 30 that delivers the output voltage $U_0$ or the output current $I_0$ via an output terminal 33. Its input receives a reference parameter $S_{I0}$ that is supplied by multiplier 35. The multiplier receives at one input the output signal of a subtractor 36 to which input parameter $S_U$ that is proportional to the source voltage to be preset is supplied via input terminal 31. At its second input, subtractor 36 receives a measured parameter $M_{U0}$ which is proportional to the output voltage $U_0$ and is supplied by a voltemer 34 connected to the output of current regulator 30. The second input of multiplier 35 receives an input parameter $S_R$ over an input terminal 32 which is inversely proportional to the internal resistance to be set.

The circuit arrangement shown in FIG. 3 thus operates in such a way that first the difference is formed from the two values proportional to the source voltage and the output voltage $U_0$ to be preset, after which this difference is multiplied by the inverse of the internal resistance to be preset in order to form reference parameter $S_{I0}$. It is apparent that the circuit arrangement shown in FIG. 3 thus satisfies equation (2) given above for the output current $I_0$ of a voltage source. The practical example shown in FIG. 3 thus also works without any separate variable ideal voltage source and without resistors in the output current circuit to set a given internal resistance.

Figure 4:
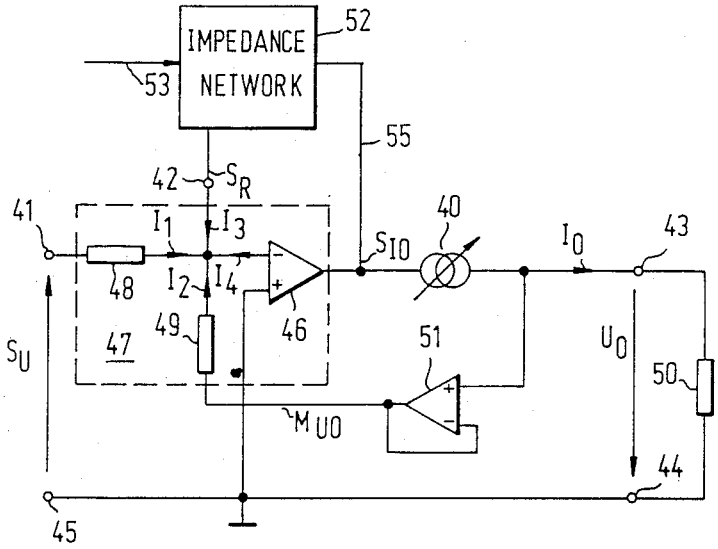
FIG. 4 shows one practical example of this invention with a current regulator.

FIG. 4 shows another practical example of this invention. This circuit arrangement operates according to the principle illustrated above on the basis of FIG. 3. Input parameter $S_U$ is sent to it as a voltage signal at input terminals 41 and 45, and input parameter $S_R$ is sent to it as a current signal at an input terminal 42. The reference parameter $S_{I0}$ for a current converter 40 that delivers output current $I_0$ or output voltage $U_0$ at output terminals 43 and 44 is generated by a computing circuit 47. A load resistor 50 is connected to output terminals 43 and 44.

In addition to input parameters $S_U$ and $S_R$, computing circuit 47 also receives measured parameter $M_{U0}$ which is sent to it by an operation amplifier 51 that is connected as a voltage sequencer. The operation amplifier functions as a voltmeter and measures the output voltage $U_0$ of the current regulator 40.

In computing circuit 47, the input parameter $S_U$ is sent to the inverting input of an operation amplifier 46 across an input resistor 48, and measured parameter $M_{U0}$ is sent to the inverting input of the operation amplifier across an input resistor 49 together with input parameter $S_R$. The noninverting input of the operation amplifier is connected to ground or terminals 44 and 45 of the circuit. Operation amplifier 46 operates as a summation amplifier and supplies the reference parameter $S_{I0}$ for the current regulator 40 at its output. The signals supplied to the noninverting input generate currents $I_1$, $I_2$ and $I_3$ which together with an input current $I_4$ of the operation amplifier 46 will be explained in greater detail below.

Input parameter $S_U$ which is proportional to the source voltage that is to be preset has according to FIG. 4 a direction such that it is used to form a difference with measured parameter $M_{U0}$ when sent to the inverting input of the operation amplifier 46 and the resultant polority reversal, so the operation amplifier 46 thus amplifies the difference between these two parameters. The degree of amplification of the operation amplifier 46 can be varied so in this way the amplification of such difference can be provided with a factor that can be set in accordance with the input parameter $S_R$ that is in inverse ratio to the internal resistance to be preset. The circuit shown in FIG. 4 is provided accordingly with a feedback path for the operation amplifier 46 containing an adjustable impedance network 52 which can be adjusted by a setting control 53 in accordance with various input parameters $S_R$.

The circuit shown in FIG. 4 thus contains a very simple computing circuit 47 which contains only the operation amplifier 46 and the input resistors 48 and 49. When using the nodal point rule for currents $I_1$, $I_2$ and $I_3$, disregarding current $I_4$, the following equation holds for this computing circuit 47

$$I_1+I_2+I_3=0 \tag{3}$$

Since the currents $I_1$ and $I_2$ are generated by voltage signals $S_U$ and $M_{U0}$ at resistors 48 and 49, it can be shown that the reference parameter $S_{I0}$ for the current regulator 40 corresponds to the following equation:

$$S_{I0}=R_{52}/R_{49}(R_{49}/R_{48}\cdot S_U-M_{U0}) \tag{4}$$

where $R_{52}$ is the resistance value of the impedance network 52, $R_{48}$ and $R_{49}$ are the values of the resistors 48 and 49, $S_U$ is the value of the input parameter corresponding to the source voltage to be preset and $M_{U0}$ is the measured parameter proportional to output voltage $U_0$. By comparison with equation (2), it can be seen that the ratio $R_{49}/R_{48}$ is a proportionality factor by means of which the source voltage simulated by the circuit arrangement according to FIG. 4 differs from the input value $S_U$. In addition, the ratio $R_{52}/R_{49}$ corresponds to the ratio $1/R_I$ and can be set by varying the resistance value $R_{52}$ according to different internal resistance values to be preset.

Figure 5:
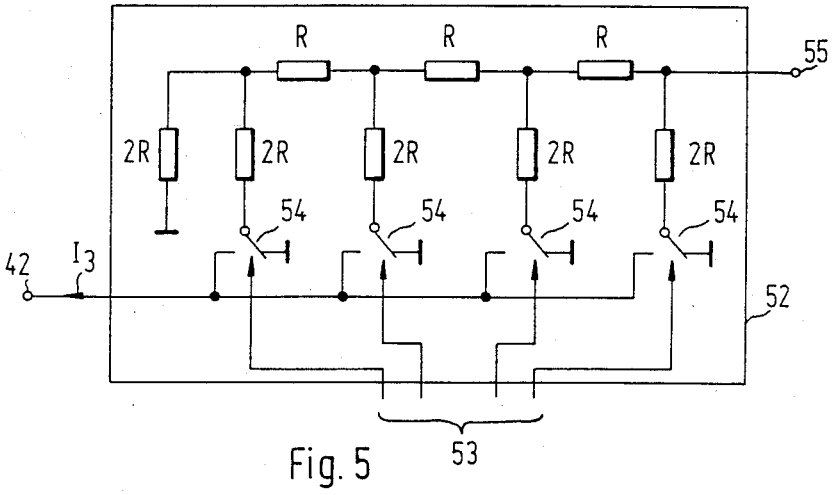
FIG. 5 shows a multiplying digital-analog converter for use in the circuit according to FIG. 4.

One possibility of generating the input parameter $S_R$ that is inversely proportional to the internal resistance value to be preset or generating current $I_3$ for the circuit shown in FIG. 4 is explained below. FIG. 5 shows a resistance network which is based on the principle of a multiplying digital-analog converter and contains resistance values R in its longitudinal branch to which the respective parallel branches are connected with a resistance value 2R. In addition, the circuit is closed by another resistance value 2R which is connected to ground potential. Reversing switches 54 are controlled between two possible switch settings via control inputs 53. In the first switch position, they connect the respective parallel branch with a resistance value 2R to ground potential, and in the second switch setting they connect the respective parallel branch to the input terminal 42 of the circuit shown in FIG. 4. The longitudinal branch of the resistance network shown in FIG. 5 is connected to the output of the operation amplifier 46 shown in FIG. 4 via an input terminal labeled as 55. The resistance network is thus in the feedback path of operation amplifier 46.

With the digital-analog converter shown in FIG. 5, digital input parameters supplied over control inputs 53 can be converted to analog output parameters at terminal 42. Current $I_3$ which is supplied to the circuit shown in FIG. 4 when voltage signal $S_{I0}$ is applied to input terminal 46 as input parameter $S_R$ has the respective value $$I_3=m/2^n\cdot S_{I0}/R \tag{5}$$

where n is the width of the digital data word which is sent to control inputs 53, and m is the width of the value of this data word which can be adjusted from 0 to $2^{n-1}$.

Applying this current value to equation (3) given above then leads to an equation similar to equation (4)

$$S_{I0}=R\cdot 2^n/m\cdot 1/R_{49}(R_{49}/R_{48}\cdot S_U-M_{U0}) \tag{6}$$

By comparison with equation (2), this yields the following for the input parameter that is inverse proportion to the internal resistance $R_I$ that is to be preset $$S=R\cdot 2^n/R_{49}\cdot m \tag{7}$$

When using a resistance network according to FIG. 5, in a circuit according to FIG. 4, the possible internal resistance range can be fixed in a very simple manner by means of the ratio $R/R_{49}$ contained in this equation.

What is claimed is:

1. A voltage source for delivering an electrical output and having preset values for the source voltage and internal resistance comprising:

regulating means for regulating said electrical output in accordance with a reference parameter; and computing circuit means coupled with said regulating means for calculating said reference parameter based on the value of said electrical output and said preset values.

2. The voltage source of claim 1, including means for measuring the value of said electrical output and outputting a signal corresponding to the measured value.

3. The voltage source of claim 1, including first and second inputs for receiving first and second signals respectively corresponding to said preset values for said source voltage and internal resistance.

4. The voltage source of claim 2, wherein said computing circuit means includes a substractor and a multiplier each having an input for receiving a signal corresponding to one of said preset values.

5. The voltage source of claim 4, wherein said subtractor and said multiplier are connected in series with each other and one of said subtractor and said multiplier has an input for receiving said signal corresponding to said measured value.

6. The voltage source of claim 1, wherein said computing circuit means includes an inverting summing amplifier.

7. The voltage source of claim 6, wherein said amplifier includes a feedback path and said computing circuit means includes means connected in said feedback path for adjusting the value of the signal feedback to said amplifier based on the preset value of said internal resistance.

8. The voltage source of claim 7, wherein said preset value adjusting means includes a multiplying digital-analog convertor.

9. The voltage source of claim 2, wherein said measuring means includes a voltage sequencer.

10. The voltage source of claim 1, wherein said regulating means includes a voltage regulator.

11. The voltage source of claim 1, wherein said regulating means includes a current regulator.

12. A method of producing a regulated electrical output from a voltage source having preselected electrical input values and preselected internal resistance values;

(A) measuring the value of the regulated electrical output from said voltage source;

(B) determining the preselected electrical input values and internal resistance values;

(C) calculating a reference parameter in accordance with the value measured in step (A) and the values determined in step (B); and (D) regulating the value of the electrical output from said voltage source in accordance with the value of said reference parameter.

13. The method of claim 12, including the steps of:

(E) producing a first signal representing the value of the voltage of said electrical output measured in step (A); and, (F) producing second and third signals respectively representing the preselected values of input voltage and internal resistance determined in step (B).

14. The method of claim 12, wherein step (C) includes arithmetically combining said first, second and third signals.

15. The method of claim 14, wherein said signals are arithmetically combined by providing a subtraction circuit and a multiplication circuit and inputting said second and third signals to said circuits such that each of said circuits receives one of said second and third signals.

16. The method of claim 15, wherein said signals are arithmetically combined by inputting said first signal to one of said circuits.

17. The method of claim 12, including the steps of:

(E) producing a first signal representing the value of the current of said electrical output measured in step (A); and, (F) producing second and third signals respectively representing the preselected values of input voltage and internal resistance determined in step (B).

* * * * *